US009651041B2

(12) United States Patent
Wang

(10) Patent No.: US 9,651,041 B2
(45) Date of Patent: May 16, 2017

(54) OPERATING HANDLE ASSEMBLY FOR HAND AIR PUMP

(71) Applicant: BETO ENGINEERING AND MARKETING CO., LTD., Taichung (TW)

(72) Inventor: Lopin Wang, Taichung (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 94 days.

(21) Appl. No.: 13/968,193

(22) Filed: Aug. 15, 2013

(65) Prior Publication Data

US 2013/0330212 A1 Dec. 12, 2013

Related U.S. Application Data

(63) Continuation-in-part of application No. 13/107,065, filed on May 13, 2011, now abandoned.

(30) Foreign Application Priority Data

Jan. 27, 2011 (TW) ..... 100103091 A

(51) Int. Cl.
*F04B 53/00* (2006.01)
*F04B 33/00* (2006.01)

(52) U.S. Cl.
CPC ..... *F04B 53/00* (2013.01); *F04B 33/00* (2013.01); *F04B 33/005* (2013.01)

(58) Field of Classification Search
CPC ..... F04B 53/00; F04B 33/00; F04B 33/05; F04B 33/005; F04B 9/14
USPC ..... 254/134; 81/127, 167, 177.6–177.9, 81/177.2; 417/572, 234, 415; 92/58.1
See application file for complete search history.

(56) References Cited

U.S. PATENT DOCUMENTS

| | | | | |
|---|---|---|---|---|
| 1,191,855 | A * | 7/1916 | Tuszka | 74/547 |
| 2,677,975 | A * | 5/1954 | Russell | 74/547 |
| 2,960,095 | A * | 11/1960 | Smith, Jr. | A45B 3/00 135/65 |
| 3,242,840 | A * | 3/1966 | Kremp | G03B 17/04 16/429 |
| 3,402,950 | A * | 9/1968 | Hertzberg | 403/112 |
| 3,576,190 | A * | 4/1971 | Bremshey | 135/25.4 |
| 5,494,411 | A | 2/1996 | Chuang | |
| 6,145,413 | A | 11/2000 | Lin | |
| 6,464,477 | B1 * | 10/2002 | Wu | 417/569 |
| 6,602,061 | B2 * | 8/2003 | Chuang | F04B 33/005 417/234 |

(Continued)

*Primary Examiner* — Larry E Waggle, Jr.
*Assistant Examiner* — Henry Hong
(74) *Attorney, Agent, or Firm* — Muncy, Geissler, Olds & Lowe, P.C.

(57) ABSTRACT

An operating handle assembly used with a pump to constitute a hand air pump is disclosed, including a handgrip unit having a handgrip and a pivot, and a pumping rod unit pivotally connected to the handgrip unit and turnable about a pivot center relative to the handgrip unit. The pumping rod unit includes a pivot pivotally located at the pivot of the handgrip, and a piston rod coupled to a piston hole of the pump and axially movable relative to the pump between a received position and a first extended position and turnable about the pivot center within a predetermined angle between the first extended position and a second extended position when the piston rod reaches the first extended position.

4 Claims, 11 Drawing Sheets

(56) References Cited

U.S. PATENT DOCUMENTS

| | | | | |
|---|---|---|---|---|
| 7,404,703 | B2 * | 7/2008 | Wang | 417/437 |
| 8,459,154 | B2 * | 6/2013 | Lai | B25G 1/043 81/177.1 |
| 2008/0014098 | A1 * | 1/2008 | Wu | F04B 33/005 417/234 |
| 2008/0181799 | A1 * | 7/2008 | Wu | F04B 33/005 417/455 |
| 2011/0091339 | A1 * | 4/2011 | Huang | 417/437 |
| 2013/0071264 | A1 * | 3/2013 | Wang | F04B 33/005 417/234 |

* cited by examiner

OPERATING HANDLE ASSEMBLY FOR HAND AIR PUMP

CROSS REFERENCE TO RELATED APPLICATIONS

The present application is a continuation-in-part of U.S. patent application Ser. No. 13/107,065 entitled OPERATING HANDLE ASSEMBLY FOR HAND AIR PUMP filed on May 13, 2011, now abandoned, the disclosure of which is incorporated herein by reference.

BACKGROUND OF THE INVENTION

1. Field of the Invention

The present invention relates to pumping tools and more particularly, to a foldable operating handle assembly for hand air pump.

2. Description of the Related Art

A conventional folding hand air pump, as shown in FIG. 1, comprises a handgrip unit 1 and a pumping rod unit 3. The pumping rod unit 3 is coupled to the handgrip unit 1 and turnable about a pivot center C relative to the handgrip unit 1. The pivot center C divides the handgrip unit 1 into a first part and a second part. A notch 13 is located on the first part of the handgrip unit 1 so that the pumping rod unit 3 can be biased relative to the handgrip unit 1 to reduce the length of the hand air pump.

The first part of the handgrip unit 1 of the aforesaid prior art hand air pump can be grasped by the user's hand. Because the pumping rod unit 3 is located on the first part, when the user biases the pumping rod unit 3 relative to the handgrip unit 1 to receive the hand air pump, the user's hand tends to be injured.

FIGS. 2 and 3 illustrate another design of hand air pump according to the prior art. According to this design, the handgrip unit 1 has the notch 13 located on the other end, allowing the pumping rod unit 3 to be biased relative to the handgrip unit 1 over 180°.

However, in either of the aforesaid prior art designs, the user's hand will touch the notch 13 when grasping the handgrip unit 3. It is not comfortable to touch the notch 13 when grasping the handgrip unit 3. Further, neither of the aforesaid prior art designs can absolutely eliminate accidental jamming injury during operation.

Therefore, it is desirable to provide an improved structure of hand air pump that eliminates the drawbacks of the aforesaid prior art designs.

SUMMARY OF THE INVENTION

The present invention has been accomplished under the circumstances in view. It is the main object of the present invention to provide an operating handle assembly for hand air pump, which enhances gripping comfort and safety and can be collapsed to reduce space occupation.

It is another object of the present invention to provide an operating handle assembly for hand air pump, which enables the pumping rod unit to be biased relative to the handgrip unit so that the user's hand can grasp the handgrip and pump the hand air pump comfortably and safely.

To achieve these and other objects of the present invention, an operating handle assembly is used with a pump to constitute a hand air pump, comprising a handgrip unit and a pumping rod unit pivotally connected to the handgrip unit and turnable about a pivot center relative to the handgrip unit. The handgrip unit comprises a handgrip and a pivot.

The pumping rod unit comprises a pivot pivotally located at the pivot of the handgrip, and a piston rod coupled to a piston hole of the pump and axially movable relative to the pump between a received position and a first extended position and turnable about the pivot center within a predetermined angle between the first extended position and a second extended position when the piston rod reaches the first extended position.

The various objects and advantages of the present invention will be more readily understood from the following detailed description when read in conjunction with the appended drawings.

DETAILED DESCRIPTION OF THE INVENTION

Figure 1:
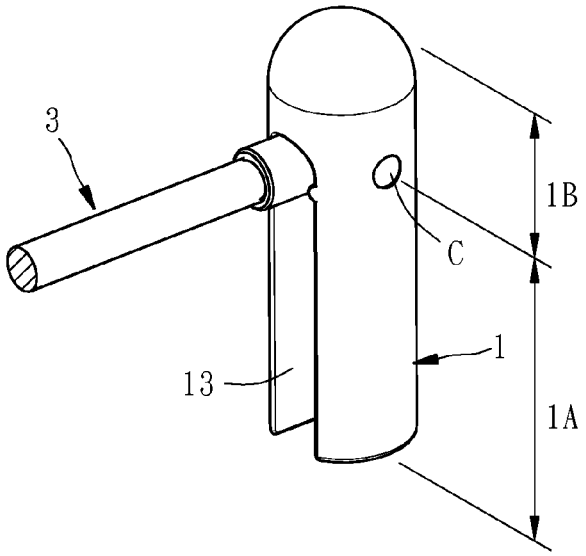
FIG. 1 PRIOR ART
FIG. 1 is an elevational view of an operating handle assembly for hand air pump according to the prior art.
Figure 2:
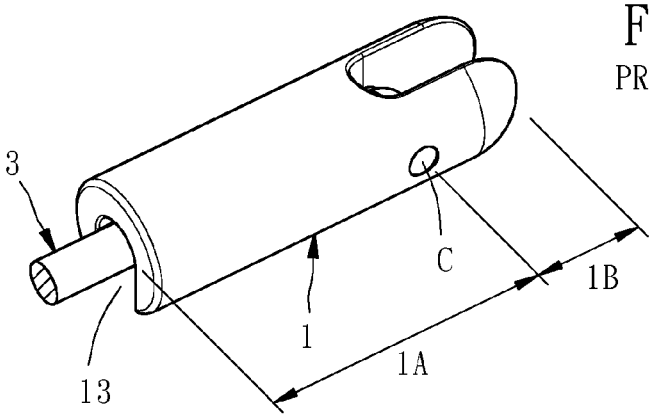
FIG. 2 PRIOR ART
FIG. 2 is an elevational view of another structure of operating handle assembly for hand air pump according to the prior art.
Figure 3:
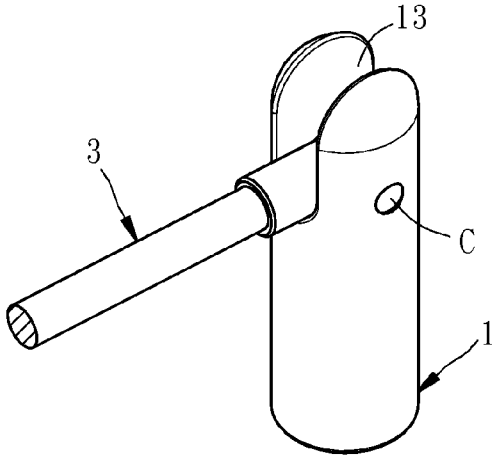
FIG. 3 PRIOR ART
FIG. 3 is another elevational view of the operating handle assembly for hand air pump shown in FIG. 2.
Figure 4:
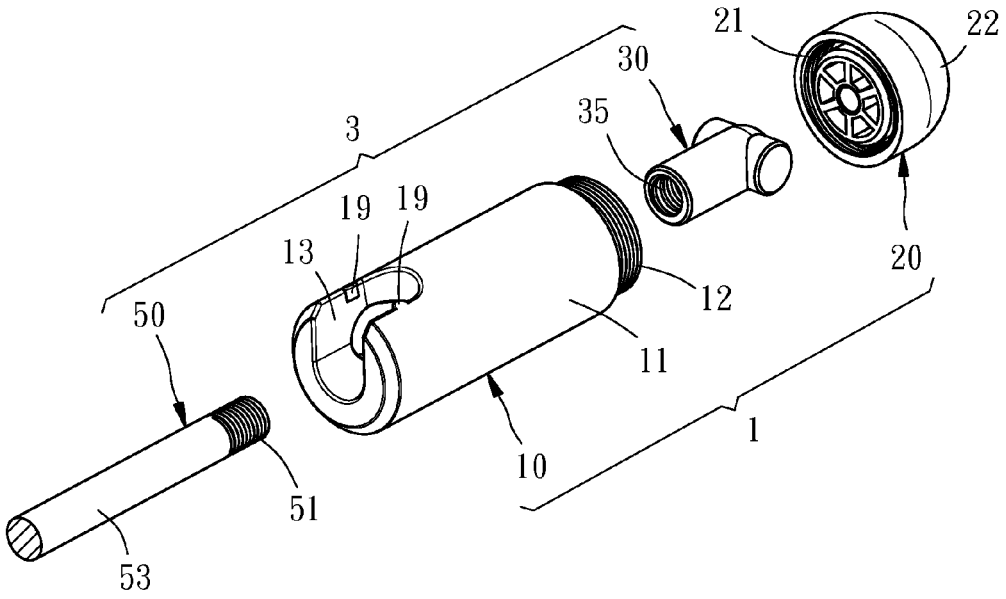
FIG. 4 is an exploded view of an operating handle assembly for hand air pump in accordance with a first embodiment of the present invention.
Figure 5:
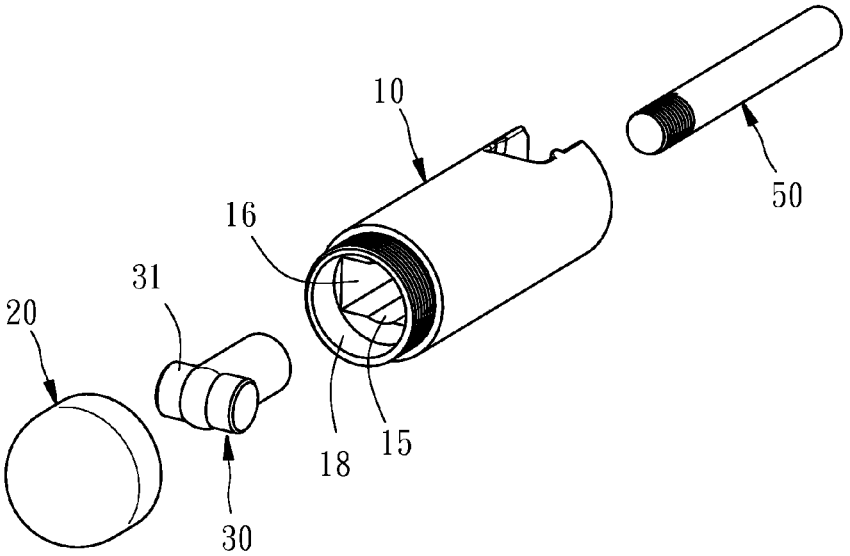
FIG. 5 corresponds to FIG. 4 when viewed from another angle.
Figure 6:
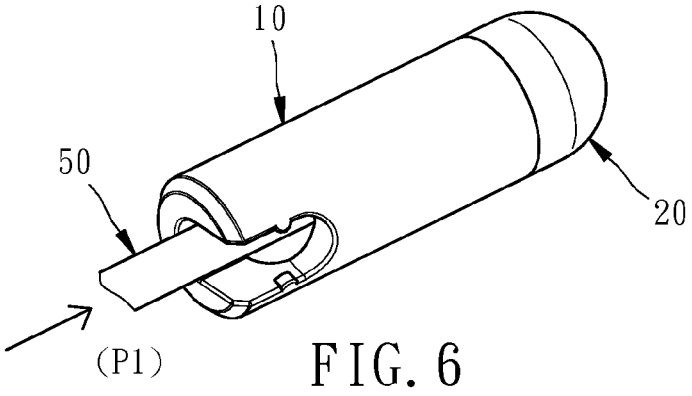
FIG. 6 is an elevational assembly view of the first embodiment of the present invention, illustrating the operating handle assembly in the received condition.
Figure 7:
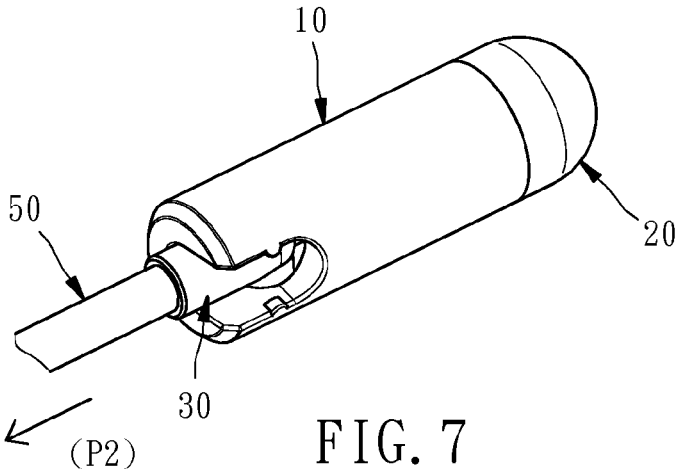
FIG. 7 corresponds to FIG. 6, illustrating the handgrip unit in the first extended position.
Figure 8:
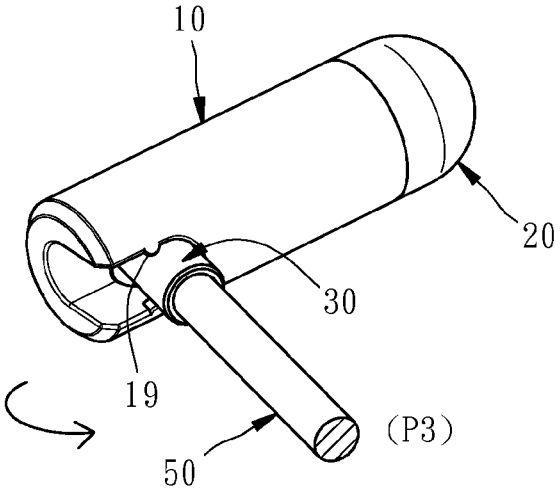
FIG. 8 corresponds to FIG. 6, illustrating the handgrip unit in the second extended position.

Referring to FIGS. 4~13, an operating handle assembly in accordance with a first embodiment of the present invention is used with a pump (not shown) to constitute a hand air pump. The operating handle assembly comprises a handgrip unit 1 and a pumping rod unit 3 pivotally connected to the handgrip unit 1 and turnable about the pivot center C.

The handgrip unit 1 comprises a handgrip 10 and an end cap 20. The end cap 20 is capped on one end of the handgrip 10 opposite to the pumping rod unit 3, having opposing connection portion 21 and end portion 22. The handgrip 10 of the handgrip unit 1 comprises an end portion 12 located on one end thereof and connectable with the connection portion 21 of the end cap 20. According to this embodiment, the end portion 12 of the handgrip 10 is externally threaded; the connection portion 21 of the end cap 20 is internally threaded for threading onto the externally threaded end portion 12 of the handgrip 10.

The handgrip 10 comprises a grip body 11, a notch 13, a pivot 14, a retraction hole 15 axially extending through the grip body 11 to the end that is opposite to the pumping rod unit 3 for receiving the pump rod unit 3 when it is moved back relative to the handgrip unit 1, two displacement match portions 16 that are disposed at two opposite lateral sides in the retraction hole 15 and kept in communication with the pivot 14, and an opening 18 kept in communication between the retraction hole 15 and the displacement match portions 16. The notch 13 extends to the pivot 14 of the handgrip unit 1, providing a space for allowing the pump rod unit 3 to be biased relative to the handgrip unit 1.

The handgrip unit 1 further comprises a first stop edge 131 disposed in the notch 13 for bearing the pumping rod unit 3 when the pumping rod unit 3 is extended out of the handgrip unit 1, and a second stop edge 132 for bearing the pumping rod unit 3 in place when the pumping rod unit 3 is turned backwards to a vertical position relative to the handgrip unit 1, and two positioning portions 19 for securing the pumping rod unit 3 in position after the pumping rod unit 3 has been turned backwards to the vertical position relative to the handgrip unit 1.

The pumping rod unit 3 comprises a piston rod 50 adapted for reciprocating a piston (not shown) in the pump of the hand air pump. The handgrip unit 1 is turnable about the pivot center C relative to the pumping rod unit 3 between a first extended position P2 and a second extended position P3.

Thus, the pumping rod unit 3 is connected to the handgrip unit 1 and pivotable relative to the handgrip unit 1 within a predetermined angle. The pumping rod unit 3 further comprises a pivot connector 30. The pivot connector 30 comprises a pivot 31 pivotally coupled to the pivot 14 of the handgrip 10 of the handgrip unit 1. The piston rod 50 of the pumping rod unit 3 is connected to the pivot connector 30 and biasable with the pumping rod unit 3 relative to the plumping rod unit 3 between the first extended position P2 and the second extended position P3 in a second segment 1B of the handgrip unit 1.

The pivot 31 of the pumping rod unit 3 is slidable out of the pivot 14 into the displacement match portions 16. The pivot connector 30 of the pumping rod unit 3 is inserted from one end of the handgrip unit 1 into the retraction hole 15 and the displacement match portions 16, i.e., the pivot connector 30 is inserted into a first segment 1A of the handgrip unit 1. After insertion of the pivot connector 30 into a first segment 1A of the handgrip unit 1, the end cap 20 is threaded onto the externally threaded end portion 12 of the handgrip 10.

Further, the pivot connector 30 and the piston rod 50 are fastened together by a screw joint. The front end of the piston rod 50 can be configured to provide a piston or attached with a piston. According to this embodiment, the pivot connector 30 comprises a connection portion, for example, screw hole 35; the piston rod 50 comprises a connection portion, for example, screw rod 51 located on its one end and threaded into the screw hole 35 of the pivot connector 30.

Viewing from the point of master-slave or superior-inferior relationship, the handgrip unit 1 includes the aforesaid handgrip 10 and end cap 20; the pumping rod unit 3 includes the aforesaid pivot connector 30 and piston rod 50. However, this is not a limitation. Alternatively, the pivot connector 30 can be included in the handgrip unit 1 or the pumping rod unit 3, i.e., the handgrip unit 1 includes the aforesaid handgrip 10, end cap 20 and pivot connector 30; the pumping rod unit 3 includes the aforesaid and piston rod 50.

The operation of the handle assembly is outlined hereinafter.

Figure 9:
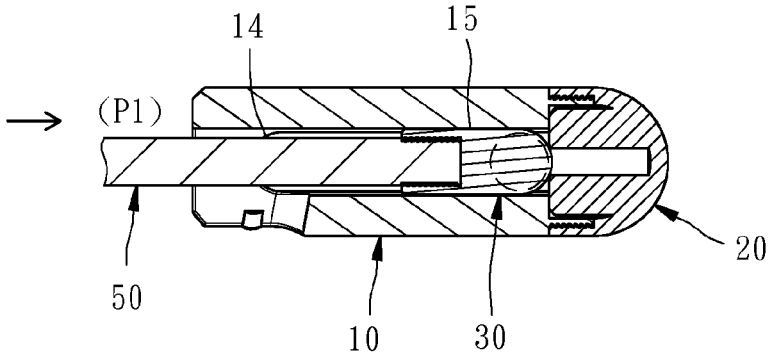
FIG. 9 is a sectional view of the first embodiment of the present invention, illustrating the handgrip unit in the received position.
Figure 10:
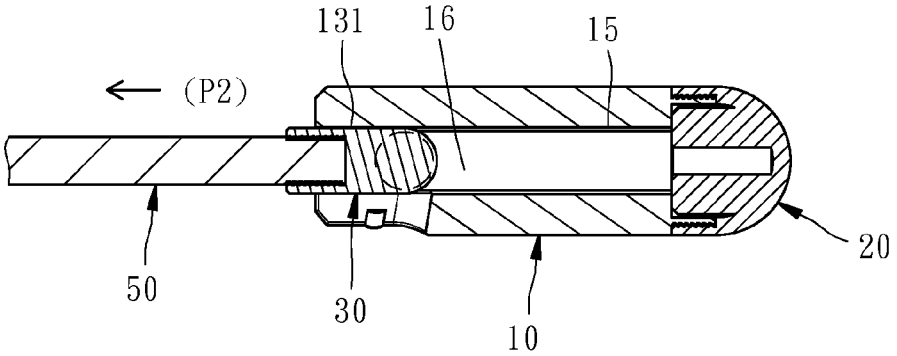
FIG. 10 is a sectional view of the first embodiment of the present invention, illustrating the handgrip unit in the first extended position.
Figure 11:
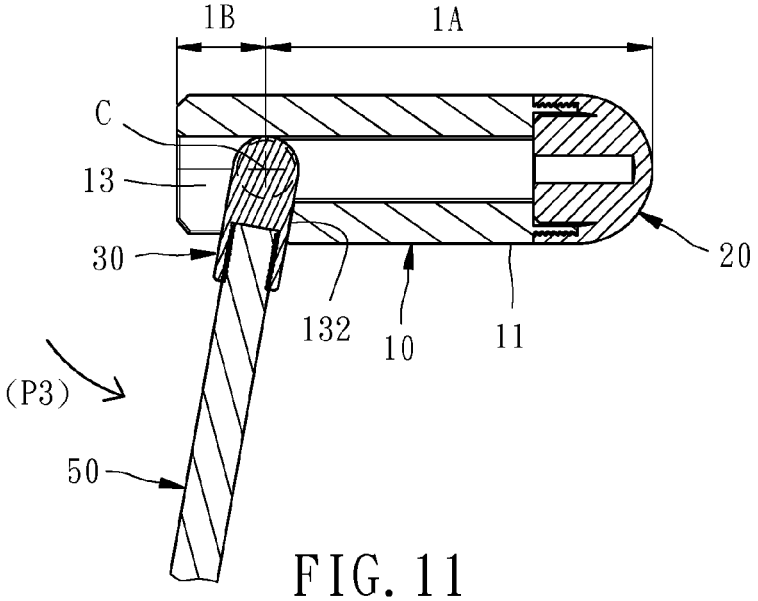
FIG. 11 is a sectional view of the first embodiment of the present invention, illustrating the handgrip unit in the second extended position.
Figure 12:
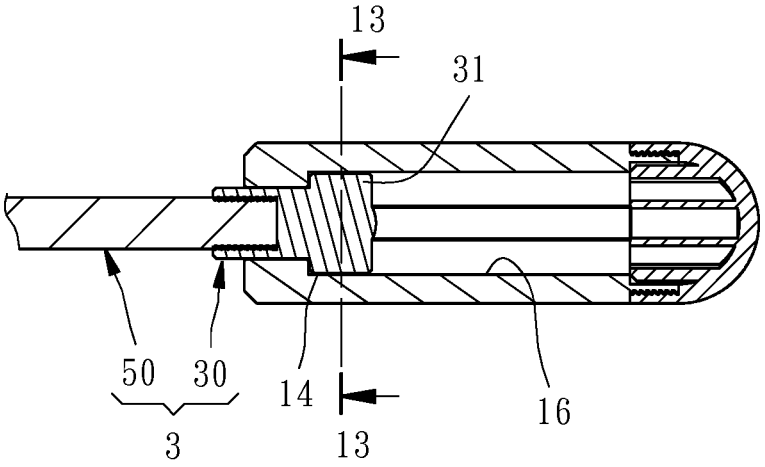
FIG. 12 corresponds to FIG. 10 when viewed from another angle.
Figure 13:
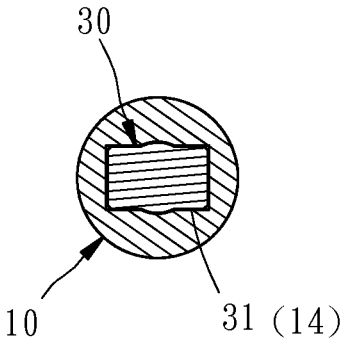
FIG. 13 is a sectional view taken along line 13-13 of FIG. 12.

At first, as shown in FIG. 9, the pumping rod unit 3 is received in the retraction hole 15 and displacement match portions 16 of the handgrip unit 1 in a received position P1, minimizing the length. At this time, the handgrip unit 1 is movable in the retraction hole 15 and displacement match portions 16 of the handgrip unit 1, i.e., the handgrip unit 1 can be moved from the received position P1 to the first extended position P2, as shown in FIG. 10.

After the handgrip unit 1 is moved to the first extended position P2, the user can bias the handgrip 10 relative to the pivot 31 of the pumping rod unit 3, i.e., to turn the handgrip 10 about the pivot center C relative to the pumping rod unit 3, to move the positioning portions 19 over the piston rod 50, enabling the pumping rod unit 3 to be stopped at the second stop edge 132.

At this time, the pivot 31 of the pumping rod unit 3 is biasable relative to the displacement match portions 16 of the handgrip unit 1. Thus, the user can bias the pumping rod unit 3 relative to the handgrip unit 1 from the first extended position P2 shown in FIG. 10 to the second extended position P3 shown in FIG. 11.

Thus, the pumping rod unit 3 can be moved axially relative to the handgrip unit 1 between the received position P1 and the first extended position P2 and then turned about the pivot center C between the first extended position P2 and the second extended position P3.

When reached the second extended position P3, the user can operate the grip body 11 of the handgrip 10 of the handgrip unit 1 to reciprocate the pumping rod unit 3 in the pump of the hand air pump to pump air.

As illustrated, the pivot center C divides the handgrip 10 of the handgrip unit 1 into the aforesaid first segment 1A and second segment 1B; the center of the pivot 14 is the pivot center C; the first segment 1A is longer than the second segment 1B; the notch 13 is located on the second segment 1B; the first extended position P2 is located on the second segment 1B; the first segment 1A is for gripping by the user's hand.

Thus, the user can hold the grip body 11 of the handgrip 10 of the handgrip unit 1 to pump the hand air pump safely avoiding jamming injury by the pumping rod unit 3. Further, because the grip body 11 of the handgrip 10 is a smooth cylinder without notch, the user does not feel discomfort when applying a pressure to the grip body 11 or pulling back the grip body 11. Further, the pumping rod unit 3 can be received in the handgrip unit 1 to reduce space occupation when not in use. Thus, the operating handle assembly of the present invention eliminates the drawbacks of the prior art designs.

Figure 14:
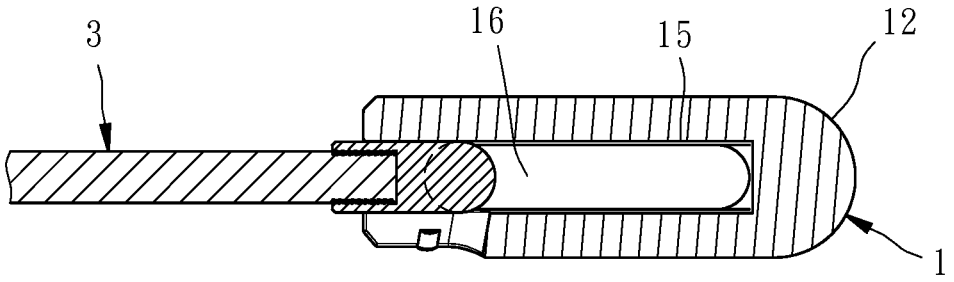
FIG. 14 is a sectional view of an operating handle assembly for hand air pump in accordance with a second embodiment of the present invention, illustrating a handgrip unit thereof in a first extended position.

FIG. 14 illustrates an operating handle assembly for hand air pump in accordance with a second embodiment of the present invention. This second embodiment is substantially similar to the aforesaid first embodiment with the exception that the handgrip unit 1 of this second embodiment includes the handgrip 10 but eliminates the aforesaid end cap 20; the handgrip 10 of the handgrip unit 1 comprises an end portion 12 located on one end thereof; the pumping rod unit 3 is mounted in the handgrip 10 through the second segment 1B.

Figure 15:
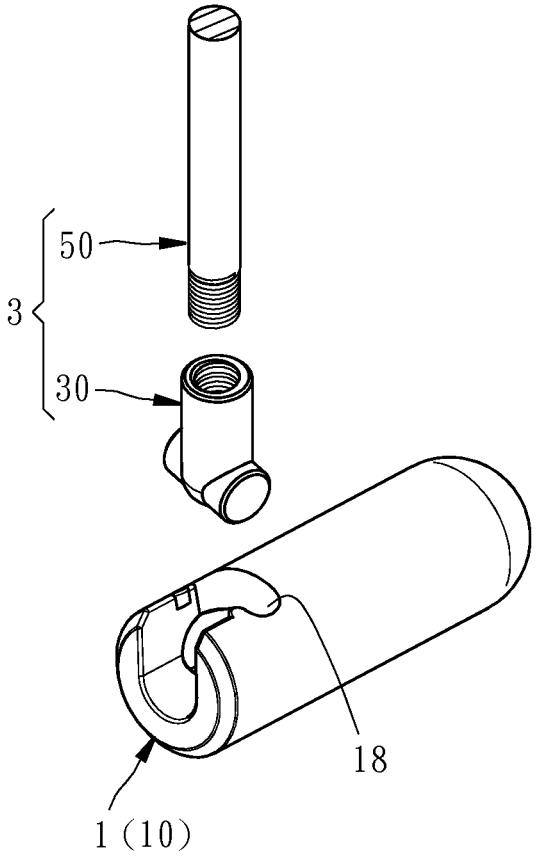
FIG. 15 is an exploded view of an operating handle assembly for hand air pump in accordance with a third embodiment of the present invention.

FIG. 15 illustrates an operating handle assembly for hand air pump in accordance with a third embodiment of the present invention. According to this third embodiment, the opening 18 of the handgrip 10 is located on the second segment 1B and kept in communication between the retraction hole 15 and the displacement match portions 16 for the passing of the pivot 31 of the pivot connector 30.

Figure 16:
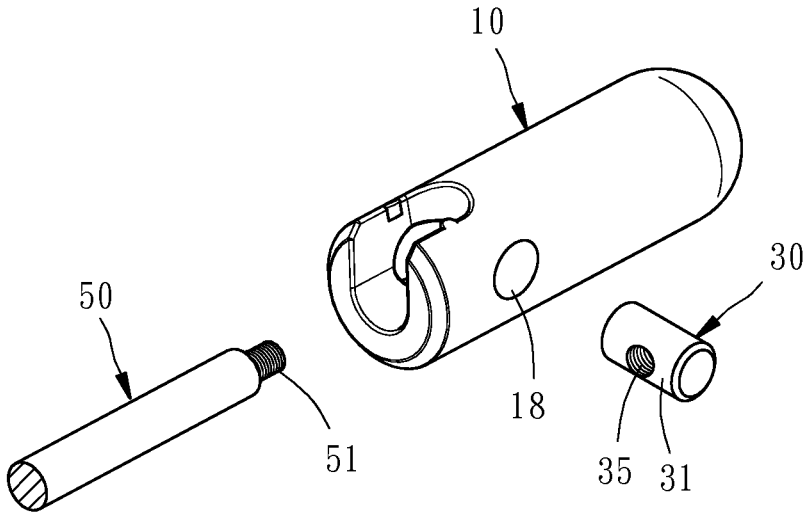
FIG. 16 is an exploded view of an operating handle assembly for hand air pump in accordance with a fourth embodiment of the present invention.

FIG. 16 is an exploded view of an operating handle assembly for hand air pump in accordance with a fourth embodiment of the present invention. According to this fourth embodiment, the opening 18 is located on the periphery of the handgrip 10; the connection portion 35 of the pivot connector 30 is a screw hole for threading into the connection portion, i.e., screw rod 51 of the pivot connector 30.

Figure 17:
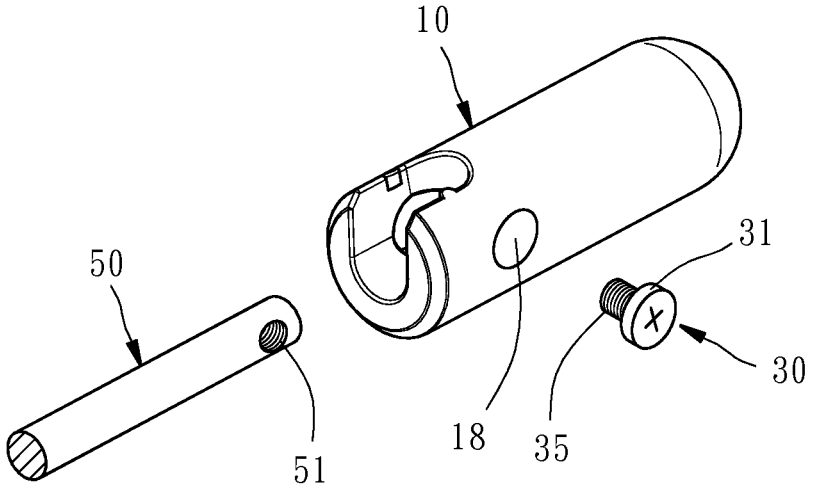
FIG. 17 is an exploded view of an operating handle assembly for hand air pump in accordance with a fifth embodiment of the present invention.
Figure 18:
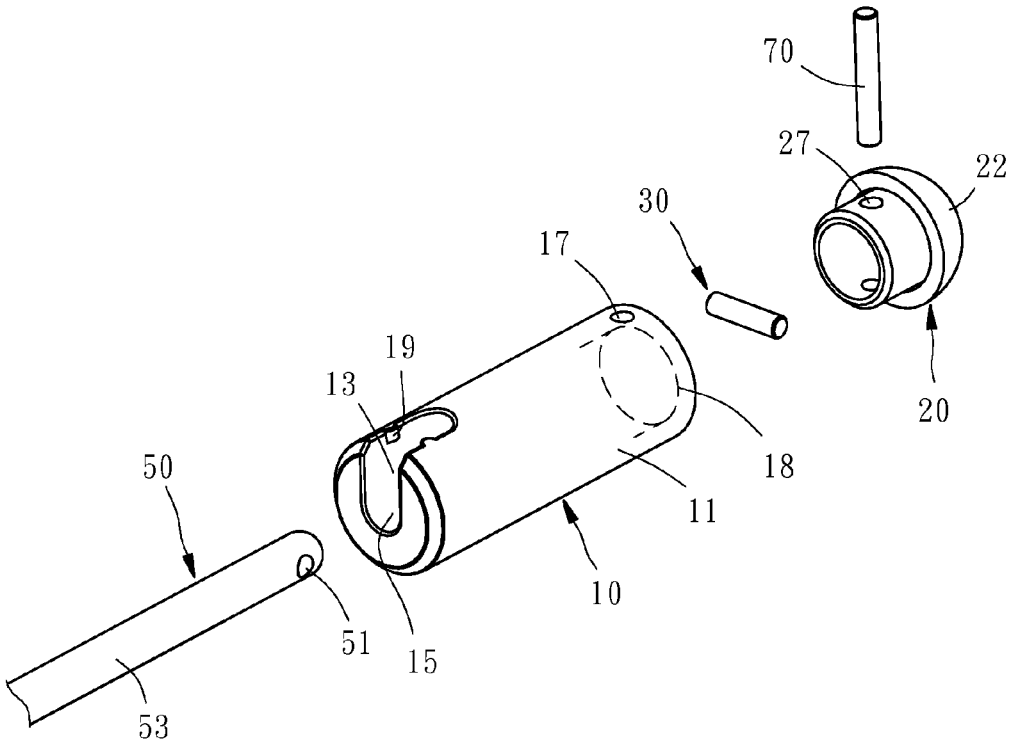
FIG. 18 is an exploded view of an operating handle assembly for hand air pump in accordance with a sixth embodiment of the present invention.
Figure 19:
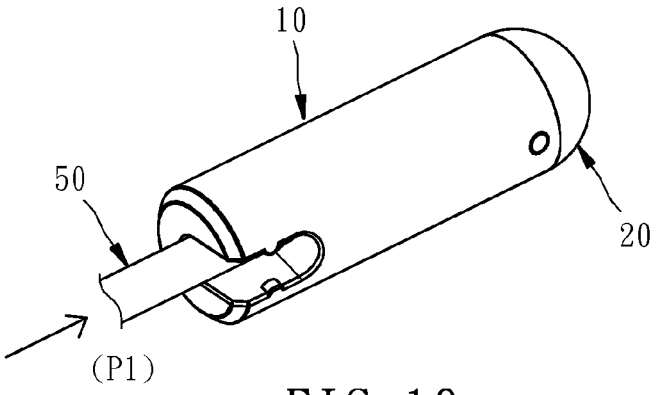
FIG. 19 is an elevational assembly view of the sixth embodiment of the present invention, illustrating the handgrip unit in the received position.
Figure 20:
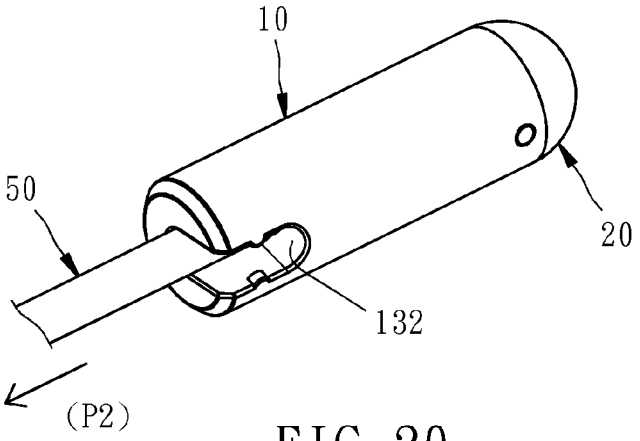
FIG. 20 is an elevational assembly view of the sixth embodiment of the present invention, illustrating the handgrip unit in the first extended position.
Figure 21:
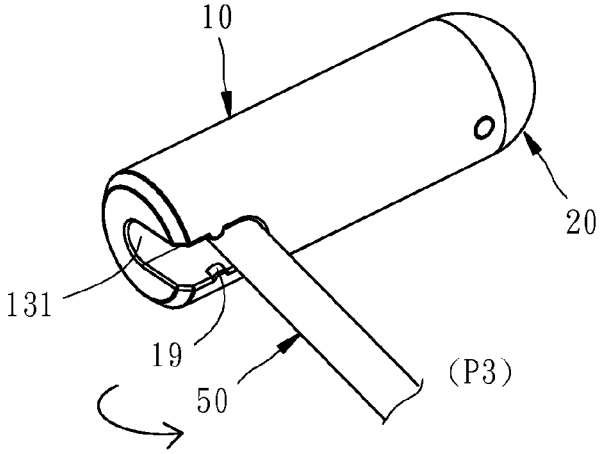
FIG. 21 is an elevational assembly view of the sixth embodiment of the present invention, illustrating the handgrip unit in the second extended position.
Figure 22:
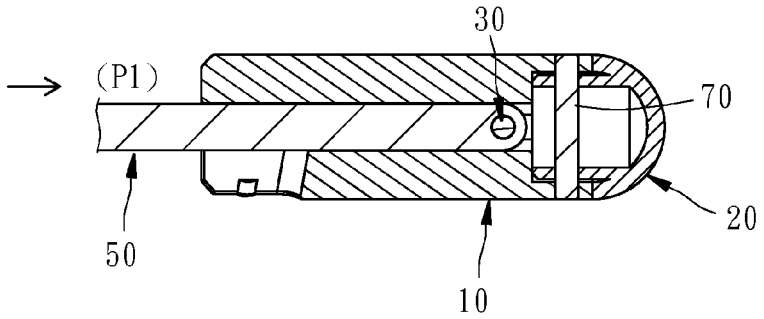
FIG. 22 is a sectional view of an operating handle assembly for hand air pump in accordance with sixth embodiment of the present invention, illustrating a handgrip unit thereof in the received position.
Figure 23:
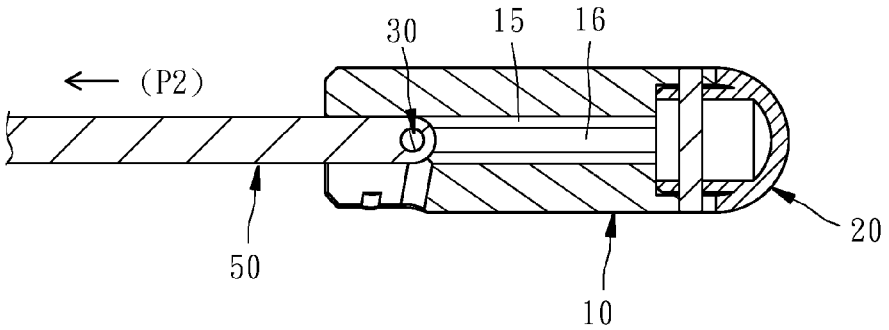
FIG. 23 is a sectional view of an operating handle assembly for hand air pump in accordance with sixth embodiment of the present invention, illustrating a handgrip unit thereof in the first extended position.
Figure 24:
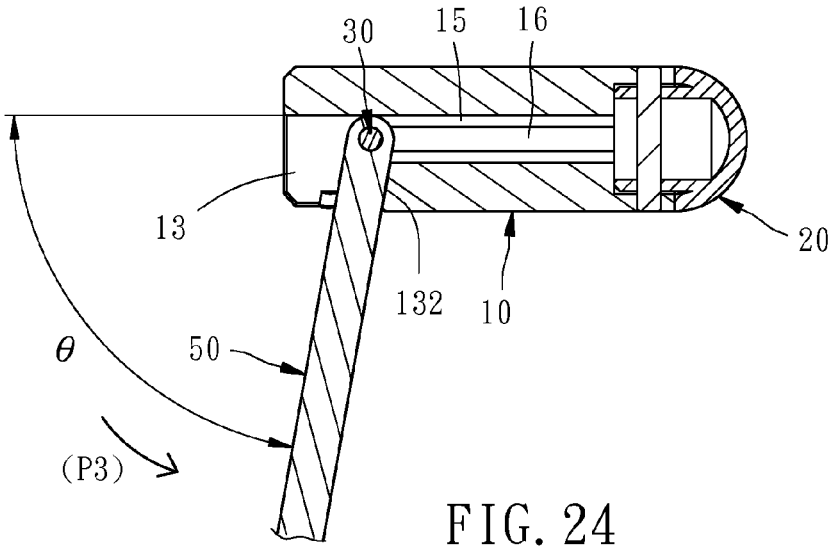
FIG. 24 is a sectional view of an operating handle assembly for hand air pump in accordance with sixth embodiment of the present invention, illustrating a handgrip unit thereof in the second extended position.
Figure 25:
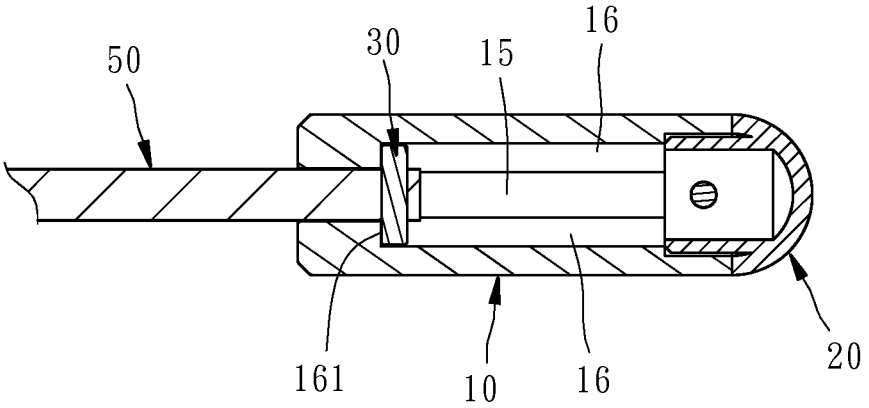
FIG. 25 is a sectional view from the other side of an operating handle assembly for hand air pump in accordance with sixth embodiment of the present invention, illustrating a handgrip unit thereof in the received position.
Figure 26:
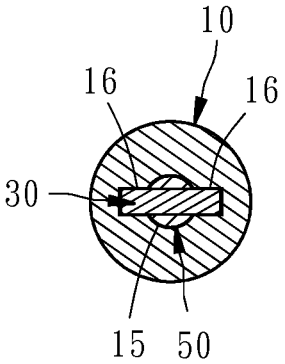
FIG. 26 is a sectional view along line 26-26 in FIG. 25.

FIG. 17 is an exploded view of an operating handle assembly for hand air pump in accordance with a fifth embodiment of the present invention. According to this fourth embodiment, the opening 18 is located on the periphery of the handgrip 10; the connection portion 35 of the pivot connector 30 is a screw rod for threading into the connection portion, i.e., screw hole 51 of the pivot connector 30.

Referring to FIGS. 18-26, another embodiment of present invention has some structures as aforesaid embodiment. The handgrip 10 of the handgrip unit has two guide slots 16, namely displacement match portion, that are disposed at two opposite lateral side in communication with the retraction hole 15, a slot bottom 161 is provided at the end of each guide slot 16, a notch 13 communicates with the retraction hole 15, an opening 18 kept in communication between the retraction hole 15 and the guide slots 16.

The connection portion of the piston rod 50 of the pumping rod unit is a pin hole 51 and the pivot connector is a pin 30, said pin 30 inserts in the pin hole 51 of the piston rod 50. In light of this, the diameter of the pin 30 is smaller than the diameter of the rod body 53 of the piston rod 50.

The rod body 53 moveable places in the retraction hole 15. The width of the guide slot 16 enables the pin 30 to slide. After assemble of the piston rod 50 and the pin 30, the piston rod 50 and the pin 30 are placed into the handgrip 10 from the opening 18. The pin 30 is placed in the guide slot 16. By this way, the width of the guide slot 16 is smaller and the surface area of the retraction hole 15 can be extended to increase the touch area between the rod body 53 and the retraction hole 15. The pin 30 slide within the guide slot 16 preventing the radial rotation of the piston rod 50.

The guide slot 16 of the handgrip unit provides the pin 30 to slide and the pin 30 is axially moveable relative to the handgrip unit between a received position P1 and a first extended position P2. The slot bottom 161 of the handgrip unit provides the pin 30 to bias, the pumping rod unit can bias between the first extended position P2 and a second extended position P3. The handgrip unit includes two positioning portion 19, which locates on the opposite side of the notch 13. These two positioning portions 19 position the piston rod 50 of the pumping rod unit 3. The pumping rod unit bias between the first extended position P2 and the second extended position P3 limited by the first stop edge 131 and the second stop edge 132 and defines a bias angle θ. The bias angle θ of present embodiment is 80 degrees but a preferable bias angle θ is between 77.5 degrees and 82.5 degrees. The bias angle θ can cooperate with user's hand and save power when use. Another preferable bias angle θ is between 75 degrees and 85 degrees.

Moreover, the handgrip 10 includes a post hole 17 and the end cap 20 includes a post hole 27 too. There is a post 70 inserted in the post hole 17 and the post hole 27 when the end cap 20 assembled with the handgrip 10. By this way, the end cap 20 can quickly and easily fix with the handgrip 10. When the handgrip unit was received, the post 70 stops the piston rod 50 and prevents the piston rod 50 falling out from the end cap 20.

Other modifications can be made without departing from the spirit and scope of the invention.

For example, the pivot connector 30 of the pumping rod unit 3 and the piston rod 50 can be formed in integrity; the pivot 14 and the pivot 31 can be respectively formed on the handgrip 10 and the pumping rod unit 3 for matching, eliminating the aforesaid pivot connector 30.

Further, the pivot connector 30 can be included in the handgrip unit 1, i.e., the pivot connector 30 can be installed in the handgrip unit 1. Alternatively, the pivot connector 30 can be included in the pumping rod unit 3, i.e., the pumping rod unit 3 includes the pivot connector 30.

Further, the displacement match portions 16 are not requisite, i.e., the handgrip unit 1 is simply configured to provide the pivot 14 and the retraction hole 15 for allowing the pivot 31 of the pumping rod unit 3 to be moved axially back and forth. Other alternate arrangements can be made for allowing the handgrip unit 1 to be moved axially back and forth relative to the pumping rod unit 3.

Further, except the arrangement in which the handgrip unit 1 comprises at least one displacement match portion 16 for allowing the pivot 31 of the pumping rod unit 3 to be reciprocated therein, the pumping rod unit 3 can be configured to provide at least one displacement match portion 16 for allowing the pivot 14 to be reciprocated therein, i.e., the at least one displacement match portion can be made in the handgrip unit for allowing the pivot of the pumping rod unit to be reciprocated therein; alternatively, the at least one displacement match portion can be made in the pivot of the pumping rod unit for allowing the handgrip unit to be reciprocated therein.

Further, in the aforesaid various embodiments, the aforesaid retraction hole 15 is disposed in the handgrip unit 1 for receiving the pumping rod unit 3. Alternatively, the retraction hole 15 can be located on the periphery of the handgrip unit 1 or disposed at one lateral side of the handgrip unit 1 for receiving the pumping rod unit 3 in the received position.

Further, the retraction hole 15 can be kept in communication or not in communication with the at least one displacement match portion 16. When in communication, the retraction hole 15 and the at least one displacement match portion 16 can be made in integrity, i.e., the at least one displacement match portion 16 can be a part of the retraction hole 15. Further, the retraction hole 15 and the at least one displacement match portion 16 can be respectively kept in communication or not in communication with the pivot 14.

Further, the pivot connector 30 can be formed of multiple components to facilitate fabrication or installation, for example, the pivot connector 30 can be made comprising a connection member (not shown) connected to the piston rod 50, and a pivot member (not shown) pivotally located at the pivot 14 of the handgrip unit 1.

In conclusion, the invention provides an operating handle assembly for hand air pump, which is comfortable and safe in use, can be collapsed to reduce space occupation, and set in an extended operative position for pumping operation to avoid accidental injury.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A handgrip unit of a hand air pump, wherein the hand air pump comprises a cylinder and a piston rod having a first end disposed inside the cylinder and an opposite second end disposed with the handgrip unit, the handgrip unit comprising:

a handgrip of a cylindrical shape, the handgrip being provided with a retraction hole extending along a central axis of the cylindrical shape in order to receive the piston rod, the handgrip having a first end with a wall provided with an elongated notch parallel to the central axis, the notch extending from an outer surface of the handgrip to the retraction hole, the handgrip having an opposite second end and two guide slots on two lateral sides of the retraction hole, the two guide slots extending from the second end of the handgrip toward the first end of the handgrip and communicating with the retraction hole, the two guide slots being on a same plane, the plane being perpendicular to a plane where the notch lies such that a connecting area communicating with the two guide slots and the notch is formed, the second end of the piston rod being inserted inside the handgrip through the first end of the handgrip that is provided with the notch;

a pivot connector fixed at the second end of the piston rod and received in the two guide slots in a way that the handgrip is axially movable, but not turnable, relative to the piston rod; wherein when the handgrip is moved relative to the piston rod to a position where the pivot connector is located at inner distal ends of the guide slots, the handgrip is turnable about the pivot connector to an operating position in a way that the handgrip defines a predetermined angle with the piston rod;

two positioning portions provided respectively on two lateral sides of the notch of the handgrip and spaced from an inner end of the notch by a distance slightly greater than a diameter of the piston rod in order to fix the piston rod in the operating position; and an end cap provided at the second end of the handgrip to close the retraction hole and the guide slots;

wherein the pivot connector is generally T-shaped and has a central body portion threadedly connected to the second end of the piston rod and two lateral arm portions respectively received in the two guide slots and defining a pivot.

2. The handgrip unit of claim 1, wherein when the handgrip unit is in the operating position, the handgrip forms an angle between 75 degrees and 85 degrees with the piston rod.

3. A handgrip unit of a hand air pump, wherein the hand air pump comprises a cylinder and a piston rod having a first end disposed inside the cylinder and an opposite second end disposed with the handgrip unit, the handgrip unit comprising:

a handgrip of a cylindrical shape, the handgrip being provided with a retraction hole extending along a central axis of the cylindrical shape in order to receive the piston rod, the handgrip having a first end with a wall provided with an elongated notch parallel to the central axis, the notch extending from an outer surface of the hand to the retraction hole, the handgrip having an opposite second end and two guide slots on two lateral sides of the retraction hole, the two guide slots extending from the second end of the handgrip toward the first end of the handgrip and communicating with the retraction hole, the two guide slots being on a same plane, the plane being perpendicular to a plane where the notch lies such that a connecting area communicating with the two guide slots and the notch is formed, the second end of the piston rod being inserted inside the handgrip through the first end of the handgrip that is provided with the notch;

a pivot connector fixed at the second end of the piston rod and received in the two guide slots in a way that the handgrip is axially movable, but not turnable, relative to the piston rod; wherein when the handgrip is moved relative to the piston rod to a position where the pivot connector is located at inner distal ends of the guide slots, the handgrip is turnable about the pivot connector to an operating position in a way that the handgrip defines a predetermined angle with the piston rod;

two positioning portions provided respectively on two lateral sides of the notch of the handgrip and spaced from an inner end of the notch by a distance slightly greater than a diameter of the piston rod in order to fix the piston rod in the operating position; and an end cap provided at the second end of the handgrip to close the retraction hole and the guide slots;

wherein the pivot connector is a pin inserted through and fixed at the second end of the piston rod.

4. The handgrip unit of claim 3, wherein when the handgrip unit is in the operating position, the handgrip forms an angle between 75 degrees and 85 degrees with the piston rod.

* * * * *